US009650922B2

(12) United States Patent
McConville

(10) Patent No.: US 9,650,922 B2
(45) Date of Patent: May 16, 2017

(54) EXTERNAL OIL GROOVE ON A HYDRAULIC LASH ADJUSTER

(71) Applicant: Ford Global Technologies, LLC, Dearborn, MI (US)

(72) Inventor: Gregory Patrick McConville, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 205 days.

(21) Appl. No.: 14/698,493

(22) Filed: Apr. 28, 2015

(65) Prior Publication Data

US 2016/0319706 A1 Nov. 3, 2016

(51) Int. Cl.

| | |
|---|---|
| ***F01L 1/18*** | (2006.01) |
| ***F01L 1/24*** | (2006.01) |
| ***F01M 11/02*** | (2006.01) |
| ***F01M 11/00*** | (2006.01) |

(52) U.S. Cl.

CPC ..... *F01L 1/2405* (2013.01); *F01M 11/0004* (2013.01); *F01M 11/02* (2013.01); *F01L 2001/2444* (2013.01); *F01M 2011/023* (2013.01)

(58) Field of Classification Search

CPC ..... F01M 2011/023; F01M 11/02; F01M 11/0004; F01L 2001/2444; F01L 1/2405

See application file for complete search history.

(56) References Cited

U.S. PATENT DOCUMENTS

| | | | | |
|---|---|---|---|---|
| 5,544,548 | A | 8/1996 | Ihara et al. | |
| 6,196,175 | B1 | 3/2001 | Church | |
| 6,230,668 | B1 | 5/2001 | Marsh et al. | |
| 6,584,951 | B1 | 7/2003 | Patel et al. | |
| 6,758,175 | B2 | 7/2004 | Dinkel et al. | |
| 6,976,463 | B2 | 12/2005 | Spath et al. | |
| 7,047,925 | B2 | 5/2006 | Hendriksma et al. | |
| 7,174,866 | B2 | 2/2007 | Hildebrandt | |
| 7,174,869 | B2 | 2/2007 | Proschko et al. | |
| 7,946,262 | B2 | 5/2011 | Borraccia et al. | |
| 8,464,675 | B2 | 6/2013 | Waters et al. | |
| 8,640,664 | B2 | 2/2014 | Lee | |
| 8,662,035 | B1 | 3/2014 | Hendriksma | |
| 8,695,551 | B2 | 4/2014 | Langewisch et al. | |
| 2008/0178828 | A1* | 7/2008 | Patel | F01L 1/2405 123/90.12 |
| 2014/0245735 | A1 | 9/2014 | Kuske et al. | |

(Continued)

FOREIGN PATENT DOCUMENTS

| | | |
|---|---|---|
| EP | 1568851 A1 | 8/2005 |
| EP | 1892387 A1 | 2/2008 |

OTHER PUBLICATIONS

Pietrzyk, P. et al.,"Method and System for Variable Cam Timing Device," U.S. Appl. No. 14/520,174, filed Oct. 21, 2014, 98 pages.

(Continued)

*Primary Examiner* — Zelalem Eshete

(74) *Attorney, Agent, or Firm* — Julia Voutyras; McCoy Russell LLP

(57) ABSTRACT

Methods and systems are provided for a valve actuating mechanism. In one example, a method includes flowing hydraulic fluid from a first gallery to a second gallery via an external metered hydraulic fluid passage of a hydraulic lash adjuster.

20 Claims, 9 Drawing Sheets

(56) References Cited

U.S. PATENT DOCUMENTS

| | | | |
|---|---|---|---|
| 2014/0283776 | A1 | 9/2014 | Smith et al. |
| 2014/0290608 | A1 | 10/2014 | Radulescu |

OTHER PUBLICATIONS

Crowe, J. "Hydraulic Circuit for Valve Deactivation," U.S. Appl. No. 14/665,448, filed Mar. 23, 2015, 54 pages.
Beyer, T. et al. "Hydraulic Circuit for Valve Deactivation," U.S. Appl. No. 14/740,011, filed Jun. 15, 2015, 52 pages.

* cited by examiner 400
402
404
406
408
410
412
401
419
4C
414
416
418

420
408
401
416
422
Axial 450
452
454
456
458
460
462
451
469
4D
464
466
468

470
458
472
451
466
Axial

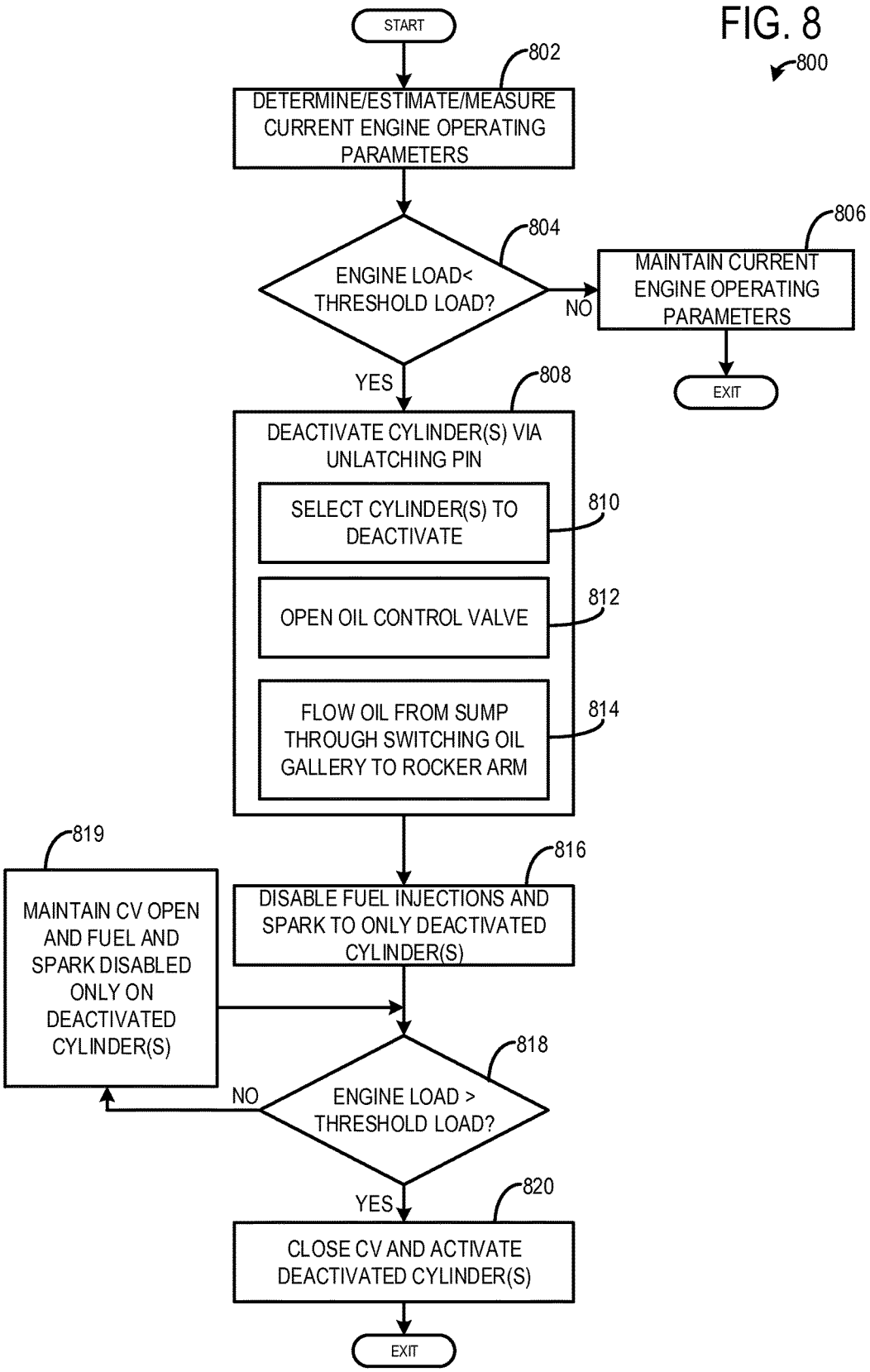
FIG. 8
800
START
802
DETERMINE/ESTIMATE/MEASURE CURRENT ENGINE OPERATING PARAMETERS
804
ENGINE LOAD< THRESHOLD LOAD?
NO
806
MAINTAIN CURRENT ENGINE OPERATING PARAMETERS
EXIT
YES
808
DEACTIVATE CYLINDER(S) VIA UNLATCHING PIN
SELECT CYLINDER(S) TO DEACTIVATE
810
OPEN OIL CONTROL VALVE
812
FLOW OIL FROM SUMP THROUGH SWITCHING OIL GALLERY TO ROCKER ARM
814
819
MAINTAIN CV OPEN AND FUEL AND SPARK DISABLED ONLY ON DEACTIVATED CYLINDER(S)
816
DISABLE FUEL INJECTIONS AND SPARK TO ONLY DEACTIVATED CYLINDER(S)
818
NO
ENGINE LOAD > THRESHOLD LOAD?
YES
820
CLOSE CV AND ACTIVATE DEACTIVATED CYLINDER(S)
EXIT

EXTERNAL OIL GROOVE ON A HYDRAULIC LASH ADJUSTER

FIELD

The present description relates generally to methods and systems for valve actuating mechanisms in engines.

BACKGROUND/SUMMARY

Many variable displacement engines employ a valve deactivation assembly including a rolling finger follower that is switchable from an activated mode to a deactivated mode. One method for activating and deactivating the rocking arm (e.g., a roller finger follower) includes an oil-pressure actuated latch pin within the inner arm of the rocker arm which, in the activated mode, engages the inner arm and outer arm in a latched condition to actuate motion of the outer arm, thereby moving a poppet valve that controls one of the intake or exhaust of gases in the combustion chamber. In the deactivated mode, the inner arm is disengaged from the outer arm in an unlatched condition, and the motion of the inner arm is not translated to the poppet valve, resulting in a lost motion.

As is typical in the valve deactivator art, mode transitions, either from the latched condition to the unlatched condition, or vice versa, occur only when the cam is on the base circle portion. That is to say, mode transitions are controlled to occur only when the roller follower is engaging the base circle portion of the cam. This is done to ensure that the mode change is occurring while the valve deactivator assembly, and more specifically the latching mechanism, is not under a load. Due to the high rotational speed of a cam, it is desirable, but difficult, to reduce the amount of time needed to transition from a latched condition to an unlatched condition in order to execute the transition during a single base circle period. The inventors have recognized that one problematic issue that may arise during mode transitions in a rolling finger follower with an oil-pressure actuated latch pin is the presence of air trapped within the latch pin circuit, which is compressible and increases the amount of time needed to switch from the latched condition to the unlatched condition or vice versa.

The latch pin hydraulic circuit of a switching rolling finger follower may be primed with a low amount of hydraulic pressure while operating in the latched condition to facilitate the transition to the unlatched condition. In one example, this priming is achieved by utilizing a dual-function hydraulic lash adjuster (HLA) which is configured to provide hydraulic fluid to a latch pin hydraulic circuit at one of a first, lower pressure or a second, higher pressure. The first and second pressures are present at the upper feed port of the hydraulic lash adjuster based on a state of an oil control valve. The hydraulic lash adjuster directs the hydraulic fluid to the latch pin hydraulic circuit via a single port located in a plunger of the lash adjuster. One example approach is shown by Hendriksma et al. in E.P. 1892387. Therein, a dual feed hydraulic lash adjuster is equipped to supply oil to two adjacent oil galleries for valve actuation mechanisms of a cylinder. The two oil galleries are fluidly coupled within the hydraulic lash adjuster in order to provide varying hydraulic fluid pressures to the valve actuating mechanisms dependent on engine conditions. A first gallery flows higher pressure hydraulic fluid to the second gallery in order to carry trapped air in the second oil gallery to a pressure relief valve.

However, the inventors herein have recognized potential issues with such systems. As one example, manufacturing a hydraulic lash adjuster with an internal passage fluidly coupled to both a first gallery and second gallery is difficult and increases a cost and complexity of the hydraulic lash adjuster. As a second example, the first gallery and second gallery are placed at equal heights and on opposite sides of the hydraulic lash adjuster which limits functionality and modularity of the hydraulic lash adjuster, specifically with a variety of variable displacement engines and oil circuit designs. The equal height of the first and second gallery also lead to the need for orientation features on the hydraulic lash adjuster and cylinder head to ensure the proper features are aligned with the respective oil galleries.

In one example, the issues described above may be addressed by a method for closing a control valve to flow hydraulic fluid from a first annular gallery to a second annular gallery of a hydraulic lash adjuster via a metered hydraulic fluid passage positioned between the first and second annular galleries and on an outer surface of a hydraulic lash adjuster body and opening the control valve to flow hydraulic fluid directly to the second gallery from the control valve. In this way, the first and second gallery may be positioned at different heights on any side of the hydraulic lash adjuster and independent of the orientation of the lash adjuster.

As one example, during vehicle operation at higher loads, the control valve may be closed such that all of a hydraulic fluid flows to the first gallery and the second gallery receives lower pressure hydraulic fluid from the first gallery via a metered passage on an outer surface of the hydraulic lash adjuster in order to displace air from the second gallery while maintaining oil pressure sufficiently low to keep a pin of an auxiliary valve actuation system (e.g., a roller finger follower) latched. In this way, all cylinders of an engine are firing and no cylinders may be deactivated. During vehicle operation at lower loads, the control valve may be opened to flow higher pressure hydraulic fluid directly to the second oil gallery via bypassing at least a portion of hydraulic fluid away from the first oil gallery. The high pressure hydraulic fluid flows from the second gallery to the auxiliary valve actuation system to unlatch the pin. In this way, one or more cylinders of an engine may be deactivated while a remaining number of cylinders may be nominally operated based on current engine operating conditions.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 8 shows a method for latching and unlatching a pin in an auxiliary valve actuating mechanism.

DETAILED DESCRIPTION

Figure 1:
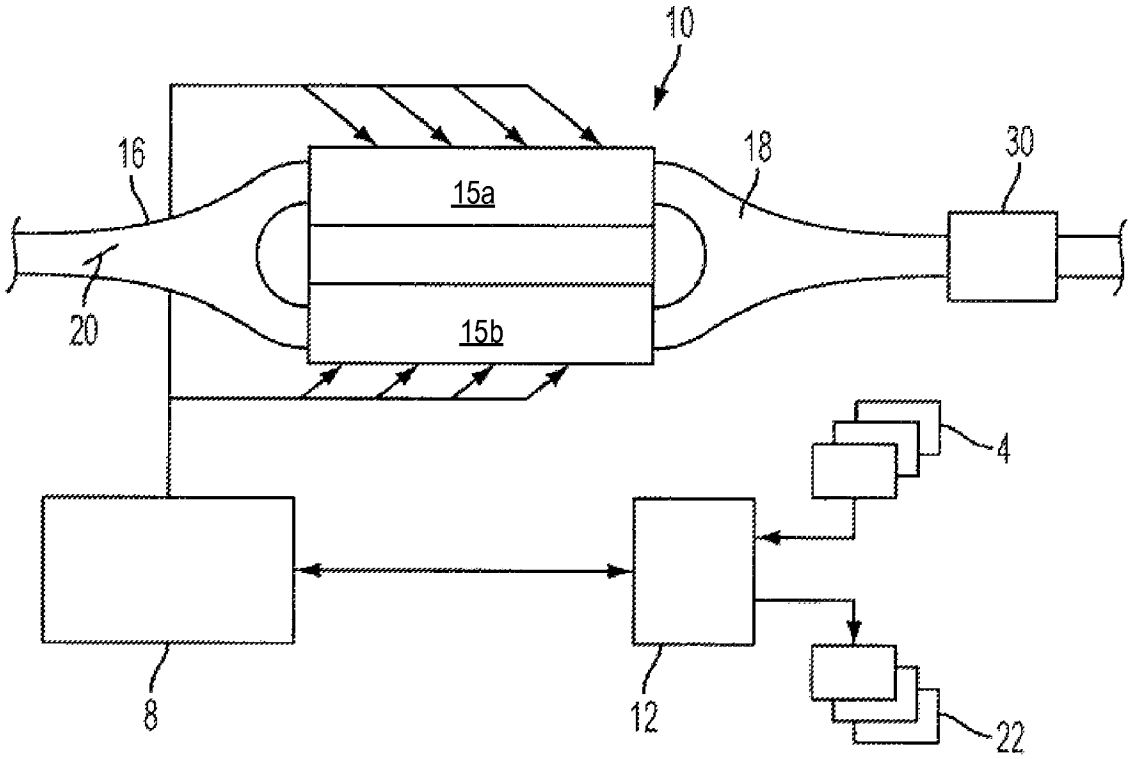
FIG. 1 shows an example engine and exhaust system layout for a variable-displacement engine (VDE).
Figure 2:
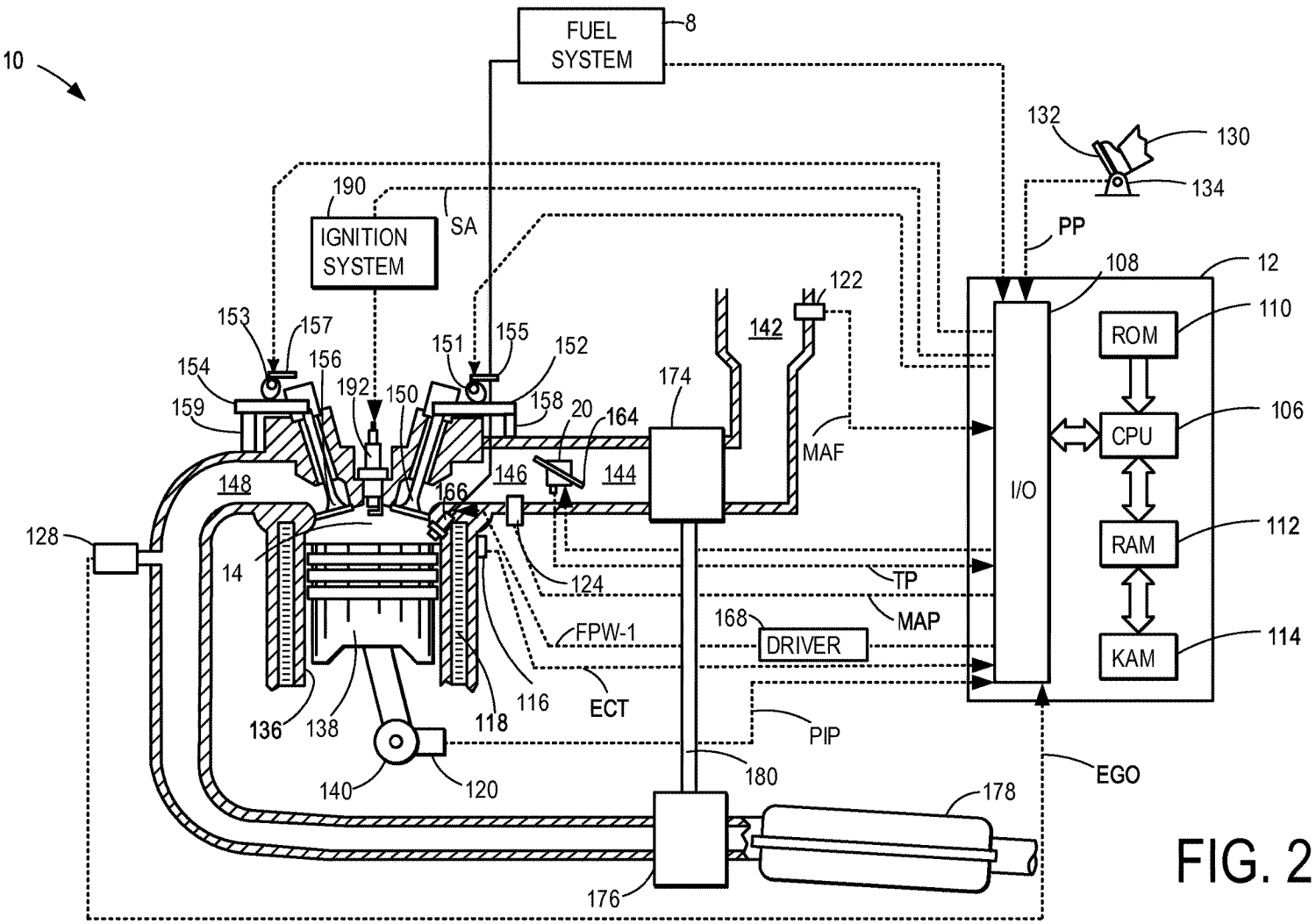
FIG. 2 shows a partial engine view of a single cylinder of an engine.
Figure 3:
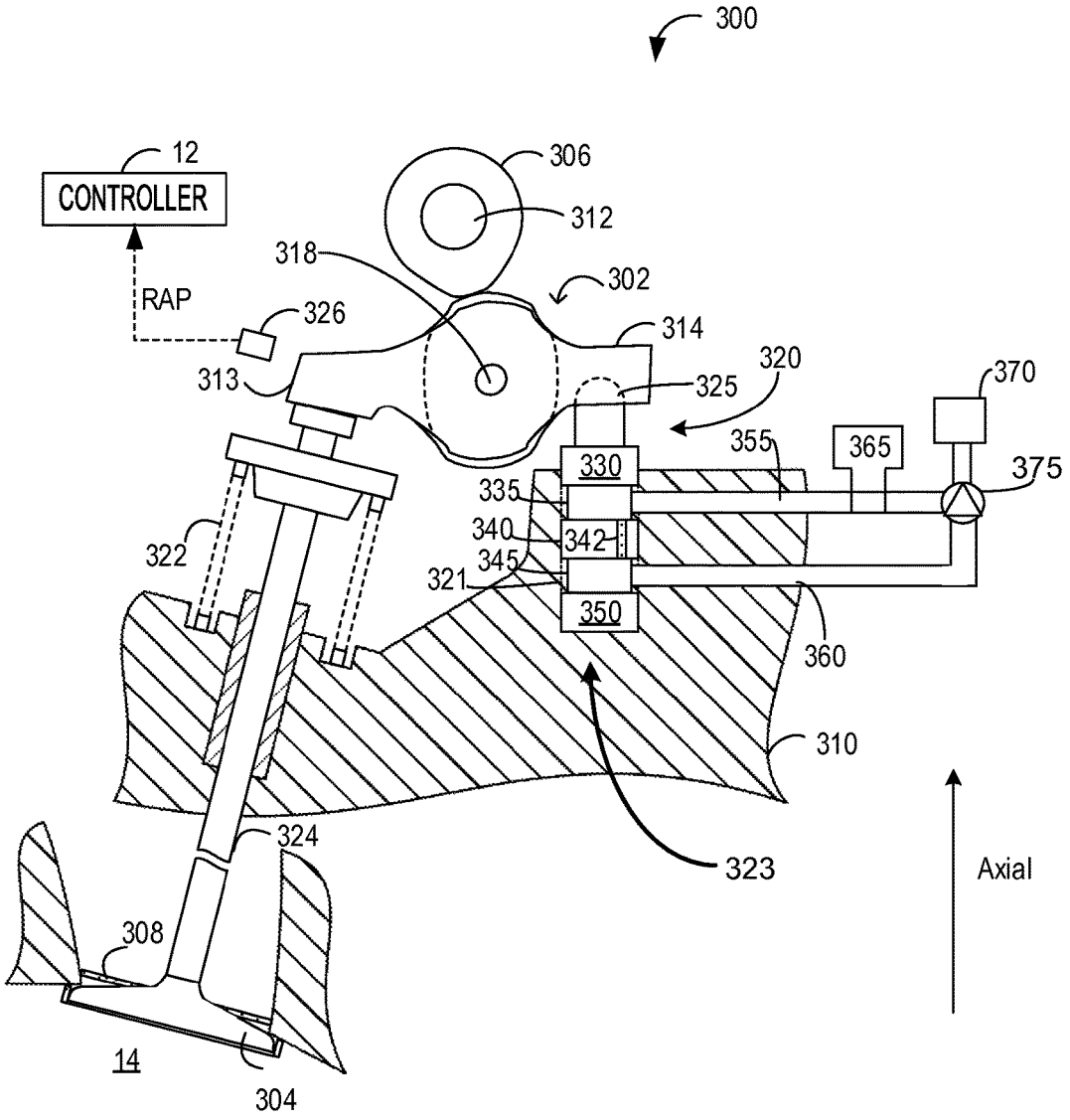
FIG. 3 shows an embodiment of a hydraulic lash adjuster including a rocker arm.
Figures 4A, 4B, 4C, 4D:
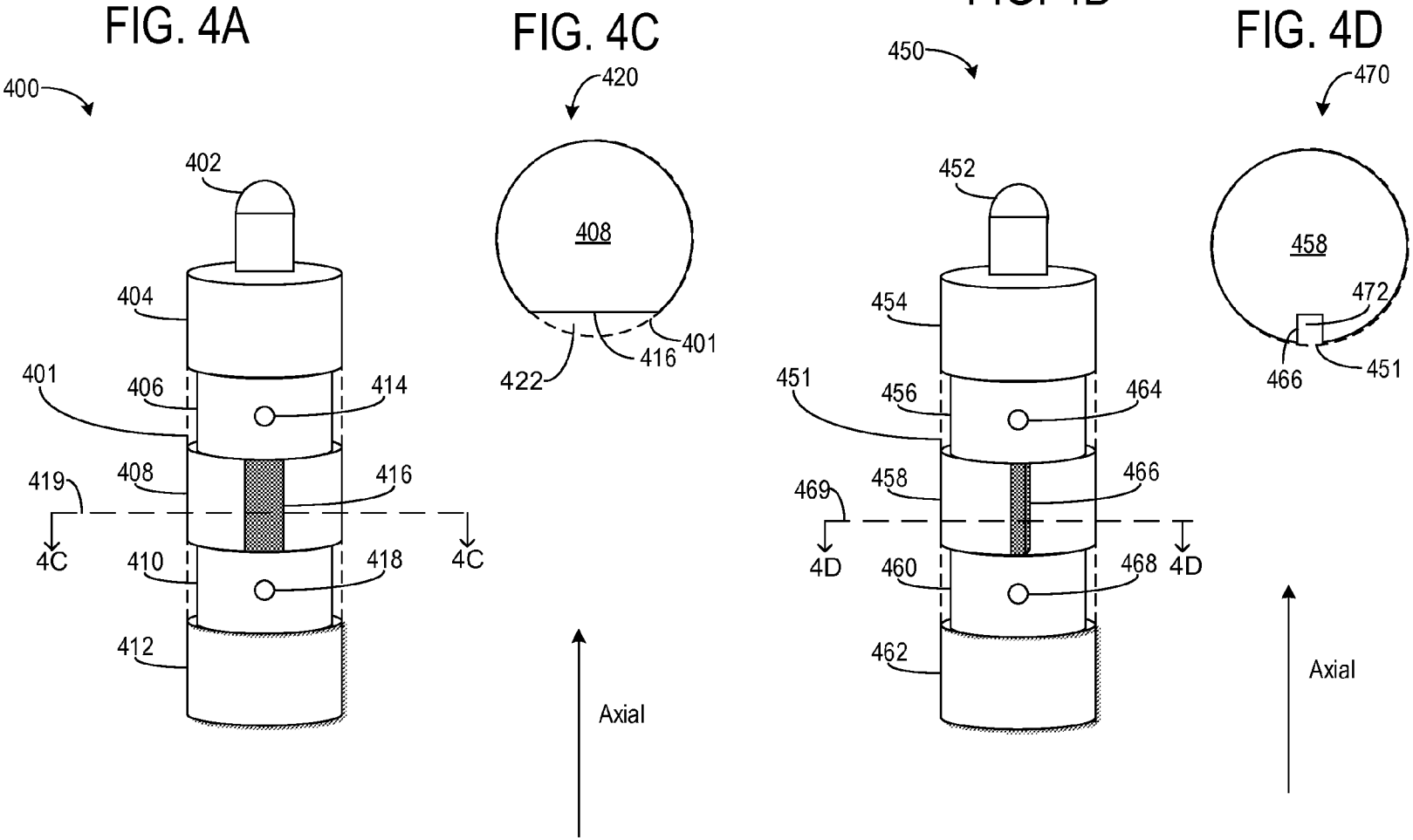
FIGS. 4A and 4B show various embodiments of a metered hydraulic fluid passage on an external surface of a hydraulic lash adjuster.
FIGS. 4C and 4D show top-down view of a cross-section of the hydraulic lash adjuster.
Figure 5:
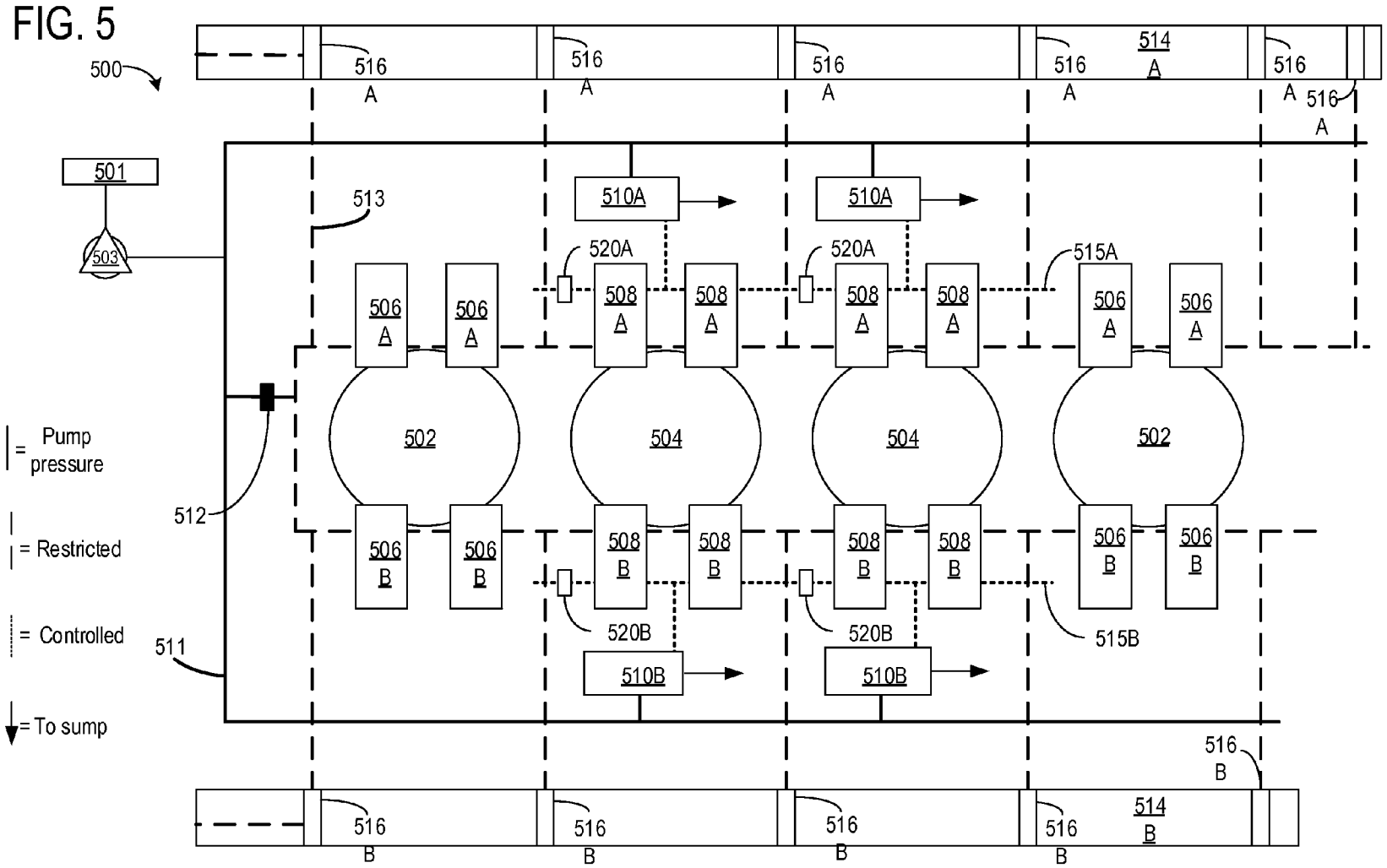
FIG. 5 shows an oil circuit of an engine.
Figure 6:
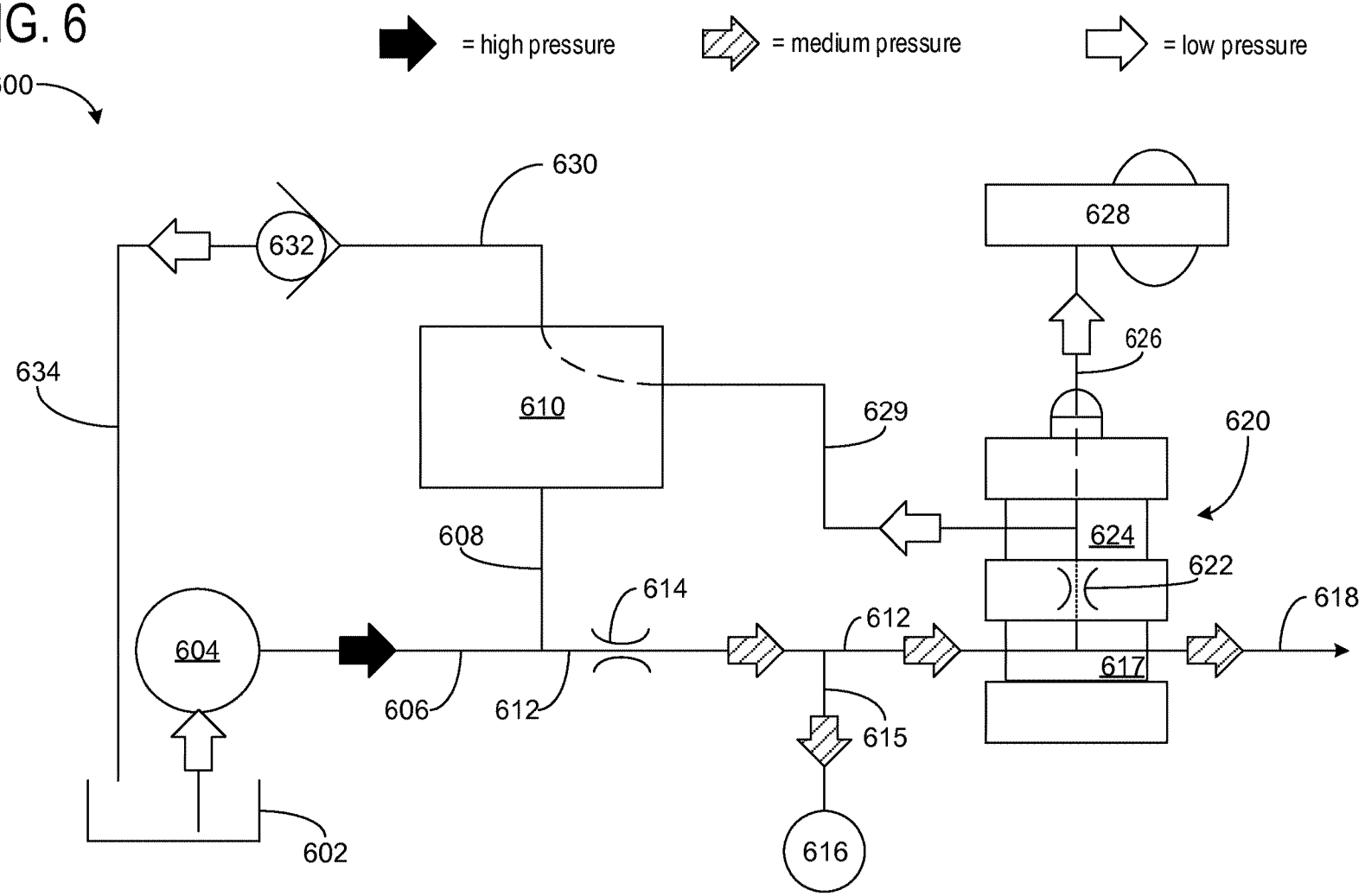
FIG. 6 shows an oil flow path for an oil circuit with a closed control valve.
Figure 7:
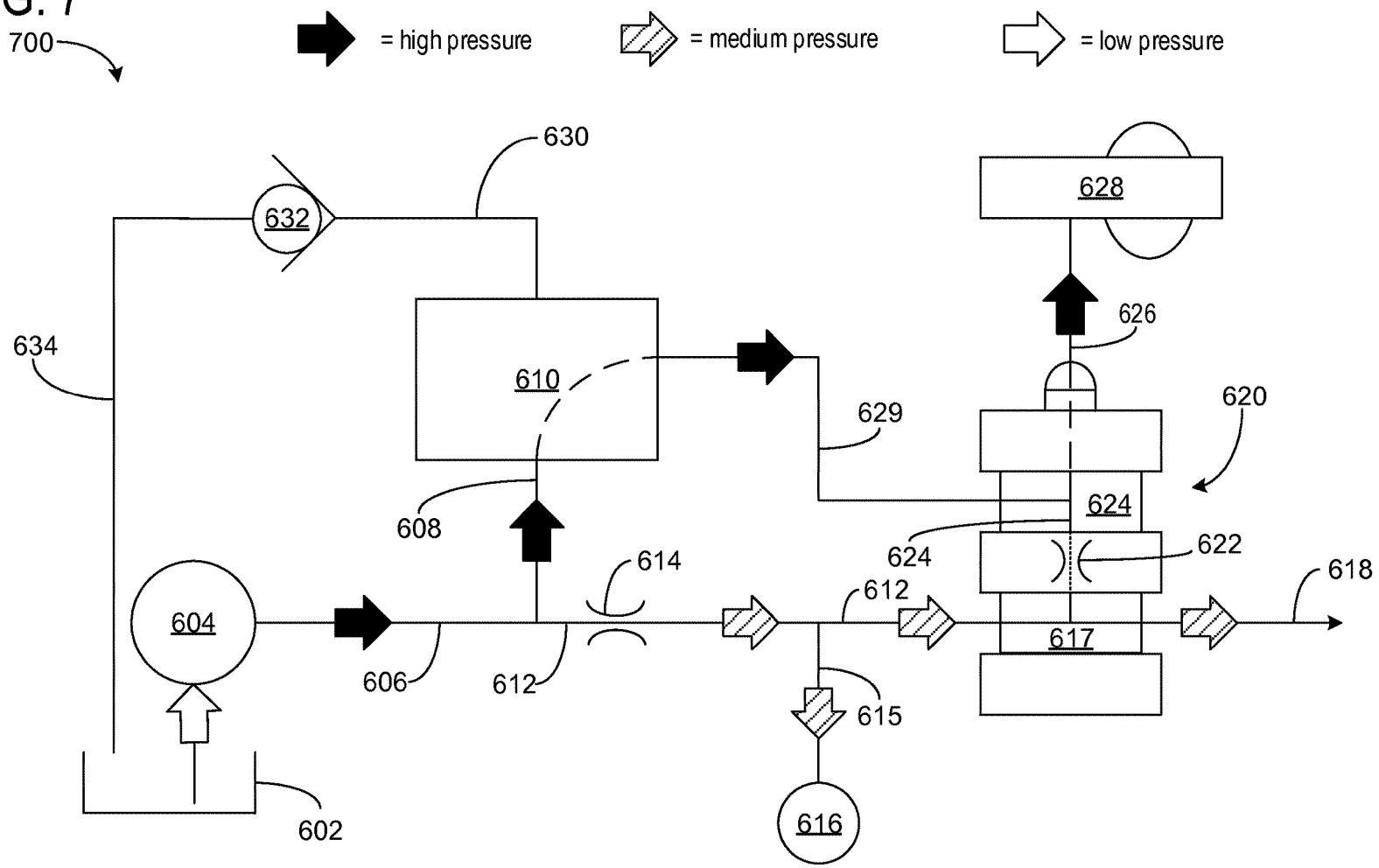
FIG. 7 shows an oil flow path for an oil circuit with an open control valve.
Figure 9B:
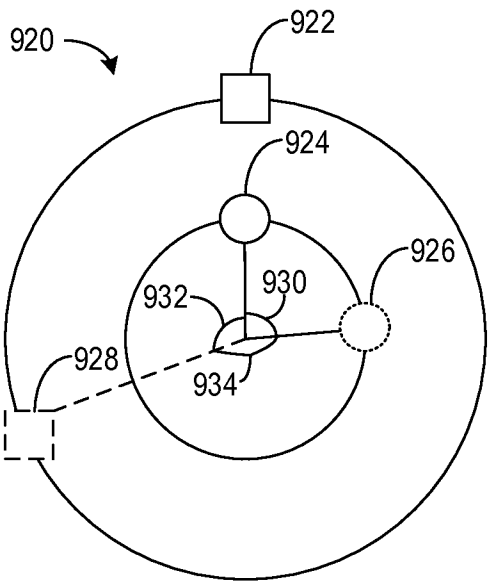
FIGS. 9A and 9B show a variety of locations for a first gallery hole, a second gallery hole, and a metered hydraulic fluid passage on a hydraulic lash adjuster.
Figure 9A:
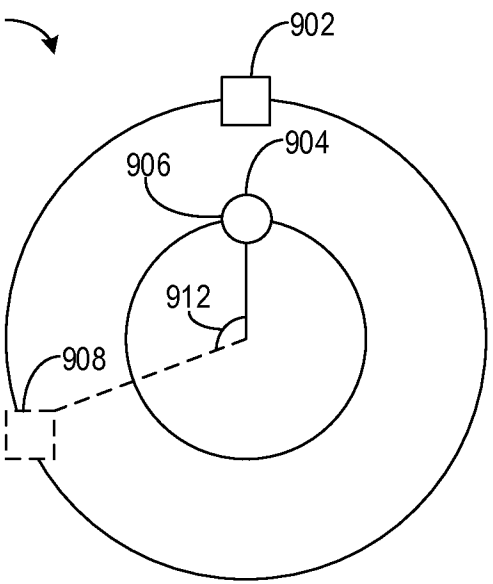

The following description relates to systems and methods for operating a hydraulic lash adjuster to flow various hydraulic fluid pressures to an auxiliary valve actuating mechanism fluidly coupled to the hydraulic lash adjuster. The hydraulic lash adjuster may be included in a variable-displacement engine as shown in FIGS. 1 and 2. An example of the hydraulic lash adjuster coupled to the auxiliary valve actuating mechanism, specifically a switchable rolling finger follower, is shown in FIG. 3. A metered hydraulic fluid passage of on an external body of the hydraulic lash adjuster may be altered and still provide a desired metered amount of hydraulic fluid. FIGS. 4A and B depict various embodiments of the hydraulic lash adjuster comprising different metered passages. Cross-sections of the hydraulic lash adjuster including various shapes for the metered passage are described below and shown with respect to FIGS. 4C and 4D. Hydraulic fluid circuits of a camshaft, hydraulic lash adjuster, and various other components of an engine is depicted with respect to FIG. 5. FIGS. 6 and 7 depict hydraulic fluid flow for a closed and open control valve, respectively. A method for operating the control valve and directing varying hydraulic fluid pressures to the second gallery of the hydraulic lash adjuster is shown with respect to FIG. 8. The first gallery, second gallery, and metered passage may be located in a variety of locations on a hydraulic lash adjuster, as shown in FIGS. 9A and 9B.

FIG. 1 shows an example V-8 variable displacement engine (VDE) 10, in which four cylinders (e.g., two in each bank) may have cylinder valves held closed during one or more engine cycles. The cylinder valves may be deactivated via a cam profile switching mechanism as illustrated in FIG. 3 in which a cam lobe with no lift is used for deactivated valves. As depicted herein, engine 10 is a V8 engine with two cylinder banks 15*a* and 15*b* having an intake manifold 16 with throttle 20 and an exhaust manifold 18 coupled to an emission control system 30 including one or more catalysts and air-fuel ratio sensors. It will be appreciated by someone skilled in the art that the engine may be of other suitable configurations (e.g., in line 4 cylinder engine).

Engine 10 may operate on a plurality of substances, which may be delivered via fuel system 8. Engine 10 may be controlled at least partially by a control system including controller 12. Controller 12 may receive various signals from sensors 4 coupled to engine 10, and send control signals to various actuators 22 coupled to the engine and/or vehicle.

FIG. 2 depicts an example embodiment of a combustion chamber or cylinder of internal combustion engine 10, along with a controller 12, of FIG. 1 is shown. As such, components previously introduced in FIG. 1 are numbered similarly and not re-introduced here for reasons of brevity. Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber') 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 2 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 20 including a throttle plate 164 may be provided along an intake passage of the engine for varying the flow rate and/or pressure of intake air provided to the engine cylinders. For example, throttle 20 may be disposed downstream of compressor 174 as shown in FIG. 2, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of both the turbine 176 and emission control device 178, but may alternatively be positioned downstream of turbine 176. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two or more intake poppet valves and at least two or more exhaust poppet valves located at an upper region of the cylinder. The valves of deactivatable cylinder 14 may be deactivated via hydraulically actuated lifters coupled to auxiliary valve actuating systems in which a cam lobe with no lift is used for deactivated valves. In this example, deactivation of intake valve 150 and exhaust valve 156 may be controlled by cam actuation via respective cam actuation systems 151 and 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake camshaft 151 and exhaust camshaft 153 may be determined by camshaft position sensors 155 and 157, respectively.

As depicted herein, in one embodiment, deactivation of intake valve 150 may be controlled by rocker arm 152 while deactivation of exhaust valve 156 may be controlled by rocker arm 154. The rocker arms 152 and 154 may be operate via a hydraulic fluid pressure fluctuation in hydraulic lash adjusters 158 and 159, respectively. By increasing or decreasing a pressure of a hydraulic fluid delivered to the hydraulic lash adjuster 158, the intake valve 150 may be deactivated (e.g., no lift) or activated (e.g., low or high lift), respectively. Likewise, by increasing or decreasing a pressure of hydraulic fluid delivered to the hydraulic lash adjuster 159, the exhaust valve 156 may be deactivated or activated, respectively. Cylinder deactivation via controlling hydraulic pressure in the hydraulic lash adjusters 158 and 159 will be discussed in more detail below. In alternate embodiments, a single oil control valve may control deactivation of both intake and exhaust valves 150 and 156 of the deactivatable cylinder 30. In still other embodiments, a single oil control valve deactivates a plurality of cylinders (both intake and exhaust valves), for example all the cylinders in the deactivated bank, or a distinct oil control valve may control deactivation for all the intake valves while another distinct oil control valve controls deactivation for all the exhaust valves of the deactivated cylinders on a bank. It will be appreciated that if the cylinder is a non-deactivatable cylinder of the VDE engine, then the cylinder may not have any valve deactivating actuators.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some embodiments, each cylinder of engine 10 may be configured with one or more fuel injectors for providing fuel thereto. As a non-limiting example, cylinder 14 is shown including one fuel injector 166. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter also referred to as "DI") of fuel into combustion cylinder 14. While FIG. 2 shows injector 166 as a side injector, it may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a high pressure fuel system 8 including fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the fuel tanks may have a pressure transducer providing a signal to controller 12. It will be appreciated that, in an alternate embodiment, injector 166 may be a port injector providing fuel into the intake port upstream of cylinder 14.

It will also be appreciated that while in one embodiment, the engine may be operated by injecting the variable fuel blend via a direct injector; in alternate embodiments, the engine may be operated by using two injectors and varying a relative amount of injection from each injector.

Controller 12 is shown in FIG. 2 as a microcomputer, including microprocessor unit 106, input/output ports 108, an electronic storage medium for executable programs and calibration values shown as read only memory chip 110 in this particular example, random access memory 112, keep alive memory 114, and a data bus. Storage medium read-only memory 110 can be programmed with computer readable data representing instructions executable by processor 102 for performing the methods described below as well as other variants that are anticipated but not specifically listed. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Further, crankshaft position, as well as crankshaft acceleration, and crankshaft oscillations may also be identified based on the signal PIP. Manifold pressure signal MAP from a manifold pressure sensor may be used to provide an indication of vacuum, or pressure, in the intake manifold.

The controller 12 receives signals from the various sensors of FIGS. 1 and 2 and employs the various actuators of FIGS. 1 and 2 to adjust engine operation based on the received signals and instructions stored on a memory of the controller, as described in further detail below.

Turning now to FIG. 3, a system 300 depicts a deactivatable cylinder 14. The cylinder 14 may be deactivated via a combination of a rocker arm 302 and a hydraulic lash adjuster 320 actuating shutting a valve (e.g., intake valve 304). Although the valve 304 is described as an intake valve, an exhaust valve may also be used.

Controller 12 may also receive a combined rocker arm position (RAP) signal from a plurality of rocker arm position sensor (RAPS), such as for example all the intake and exhaust valves of a specified engine bank. As depicted, the RAP sensor may be a Hall Effect sensor configured to determine a distance of the rocker arm from a base circle, or reference position.

FIG. 3 further elaborates a hydraulic lash adjuster coupled to the rocker arm, the hydraulic lash adjuster comprising a one piece plunger body including a first gallery for mitigating lash in a variable displacement engine and a second gallery for providing hydraulic fluid to an auxiliary valve actuation system (e.g., the rocker arm). A multi piece plunger may be a plunger including an upper body and a lower body. The lower body may include a check ball, a spring, and a retainer. The first gallery is located on a first, lower annulus and the second gallery is located on a second, upper annulus of the hydraulic lash adjuster. The first annulus and the second annulus are vertically separated by an outer diameter of the hydraulic lash adjuster body. The first gallery is fluidly coupled to a first conduit and the second gallery is fluidly coupled to a second conduit. The first gallery is fluidly coupled to the second gallery via a metered hydraulic fluid passage in an outer body of the outer diameter of the hydraulic lash adjuster body.

Specifically, system 300 depicts a controller 12 and a cylinder 14 as shown in FIGS. 1 and 2. It will be appreciated that the embodiment depicted in system 300 may be used in the embodiment with respect to FIG. 2. For example, valve 324 may be substantially identical to either intake valve 150 or exhaust valve 156. Rocker arm 302 and hydraulic lash adjuster 320 may be identical to either a combination of rocker arm 152 and hydraulic lash adjuster 158 or a combination of rocker arm 154 and hydraulic lash adjuster 159 respectively. A valve rocker arm 302 and the valve position sensor is a Hall-effect based rocker arm position sensor 326. As depicted, rocker arm 302 is coupled to intake valve 304. A change in oil pressure through the hydraulic lash adjuster 320 to the rocker arm 302 may be used to change the lift profile of the valve as well as to deactivate the valve during a VDE mode of engine operation. Rocker arm 302 may be configured to rotate about a ball pivot of a plunger 325 of the hydraulic lash adjuster 320. Specifically, the rocker arm 302 conveys radial information from the lobe of cam 306 into linear information at poppet intake valve 304 to change a valve lift amount. By changing the lift of the intake valve 304, the actuator may selectively change the amount of air flowing into the combustion chamber 14 defined in cylinder head 310 of an engine (e.g., engine 10).

Camshaft 312 is formed with intake valve drive cam 306 for actuating the intake valve. The outer end 313 of the rocker arm is raised and lowered by the rotating lobe of cam 306 to allow the rocker arm to engage and activate valve stem 324. The motion at the outer end 313 of the rocker arm is transmitted to the valve stem 324. The inner end 314 of the rocker arm is engaged to a valve lash adjuster 320 (herein also hydraulic lash adjuster) which acts as a support upon which the rocker arm 302 pivots. As the cam lobe rotates on the camshaft, it causes the outer end 313 of rocker arm 302 to press down on the valve stem 324 while pivoting about the ball of HLA plunger 325, thereby opening the intake valve 304. While the depicted examples only show an intake valve actuation system, it will be appreciated that similar configurations may be present for an exhaust valve actuation system. Further the exhaust valve drive cam may be located axially next to the intake valve drive cam along the camshaft or on a different camshaft.

It will be appreciated that the effective leverage of the rocker arm, and thus the effective force it can exert on the valve stem, is determined by the rocker arm ratio, that is, the distance from the rocker arm's center of rotation to a tip divided by the distance from the rocker arm's center of rotation to the point acted on by a cam roller (not shown). The rocker arms may be steel or aluminum providing a balance between strength, weight, and net manufacturing costs. However, in alternate embodiments, alternate materials may be used in the design of the rocker arms. In some embodiments, the rocker arm 302 may be a switchable rolling finger follower.

Hydraulic lash adjuster 320 is physically coupled to an inner end 314 of the rocker arm 302 via a plunger 325. The inner end 314 and an outer end 313 are physically and rotatably coupled to a rocker arm axle 318. The hydraulic lash adjuster 320 may be a single machined piece or multiple pieces fused together. Additionally or alternatively, the hydraulic lash adjuster 320 may be one piece with a separate plunger piece slidably disposed within the hydraulic lash adjuster 320. Plunger 325 further comprises an internal passage capable of directing hydraulic fluid from a gallery within the hydraulic lash adjuster 320 to the rocker arm 302. As described above, a pin (not shown) in the rocker arm may become latched or unlatched dependent upon a pressure of the hydraulic fluid provided to the inner end 314 of the rocker arm 302. If the pin is latched, then valve 304 of the cylinder 14 may be actuated to a variety of lift positions (e.g., high lift or low lift) by the rocker arm 302. If the pin is unlatched, then valve 304 of the cylinder 14 may not be actuated by the rocker arm 302, despite the rocker arm 302 rotating (e.g., lost motion). Alternately, with the pin unlatched, the valve may be actuated to a different lift than when latched, such as a lower lift. In this way, the cylinder 14 is deactivated upon unlatching a pin in the rocker arm 302 and the valve 304 remains at a no lift position until the pin is latched again.

The hydraulic lash adjuster 320 comprises a variety of different components. As described above, the hydraulic lash adjuster 320 comprises plunger 325 located on a top portion of the hydraulic lash adjuster, the plunger 325 is physically coupled to and fluidly coupled to the rocker arm 302. The plunger 325 is concentric with the hydraulic lash adjuster body 323 and is able to slide along an axial axis of the hydraulic lash adjuster body 323 to change the position of rocker arm 302 near inner end 314 and eliminate lash between the cam 306 and rocker arm 302 as well as between the outer end 313 and the valve stem 324. The axial axis may be defined as a vertical axis of the hydraulic lash adjuster 320 when a vehicle is placed on a surface. A capping ring (not shown) may sit at the top of the hydraulic lash adjuster body 323 to prevent the plunger 325 from extending too high above the top of the hydraulic lash adjuster body 323. The hydraulic lash adjuster 320 is located within a bore 321, indicated by small dotted lines, of the cylinder head 310. As depicted, a top portion, which includes a portion of a top, outer spool 330 and the plunger 325 of the hydraulic lash adjuster 320, extends from outside the cylinder head 310 and bore 321.

The hydraulic lash adjuster body 323 comprises five portions. The portions comprise the top, outer spool 330 nearest the rocker arm 302 and a bottom, outer spool 350 farthest away from the rocker arm 302. The top, outer spool 330 and bottom, outer spool 350 are substantially equal in diameter, and shape. Directly below the top, outer spool 330 is an upper annulus 335 which is smaller in diameter than the top, outer spool 330. Likewise, directly above the bottom, outer spool 350, is a lower annulus 345 smaller in diameter than the bottom, outer spool 350. The top, outer spool 330, the upper annulus 335, an intermediate spool 340, the lower annulus 345, and the bottom, outer spool 350 may be concentric with one another.

An intermediate spool 340 is in between and physically separates the upper annulus 335 and the lower annulus 345. The diameter of the intermediate spool 340 is substantially equal to the diameter of the top, outer spool 330 and the diameter of the bottom, outer spool 350. The intermediate spool 340 comprises a metered hydraulic fluid passage 342 which fluidly couples the upper annulus 335 to the lower annulus 345. In one example, the passage 342 spans an entire height of the intermediate spool 340.

The upper annulus 335 and the lower annulus 345 are fluidly coupled to a second gallery 355 and a first gallery 360 respectively. The bore 321 housing the hydraulic lash adjuster 320 is physically coupled to the top, outer spool 330, the bottom, outer spool 350, and a portion of the intermediate spool 340 not comprising the passage 342. Since a diameter of the upper annulus 335 and the lower annulus 345 is less than a diameter of the spools 330, 340, and 350, the annuli 335 and 345 are not physically coupled to the bore 321. A volume of fluid and/or gas may exist between an outer wall of the annuli 335 and 345 and the bore 321. The first gallery 360 may exist as a first annular gallery within a gap between the bore 321 and the lower annulus 345. Likewise, the second gallery 355 may exist as a second annular gallery within a gap between the bore 321 and the upper annulus. Additional structure of the hydraulic lash adjuster will be described in more detail with respect to FIGS. 4*a* and 4*b*.

Hydraulic fluid (e.g., oil) may flow from the first gallery 360 to the second gallery 355 or vice versa dependent upon a pressure of hydraulic fluid in the second gallery 355. In this way, a pressure of the first gallery 360 is substantially constant and a pressure of the second gallery may be altered via a control valve, as will be described below. As an example, if a pressure of hydraulic fluid in the second gallery 355 is less than a pressure of hydraulic fluid in the first gallery 360, then hydraulic fluid may flow from the first annular gallery, through the metered passage 342, and to the second annular gallery, without touching components within the hydraulic lash adjuster 320. As another example, if a pressure of hydraulic fluid in the second gallery 355 is greater than a pressure of hydraulic fluid in the first gallery 360, then hydraulic fluid may flow from the second annular gallery, through the metered passage 342, and into the first annular gallery, without interacting with components within the hydraulic lash adjuster 320.

Sump 370 provides hydraulic fluid for both the first gallery 360 and the second gallery 355 via a pump 375. Hydraulic fluid from sump 370 continuously flows to the first gallery 360. Hydraulic fluid from sump 370 flows directly to the second gallery 355 and continues through the hydraulic lash adjuster 320 to plunger 325 and rocker arm 302 only when control valve 365 is open. Hydraulic fluid continuously flows directly from sump 370 to the first gallery 360 independent of the control valve 365 being open or closed. However, when control valve 365 is open, at least a portion of hydraulic fluid bypasses the first gallery 360 and flows directly to the second gallery 355. When control valve 365 is closed, all hydraulic fluid flows through the first gallery 360 before reaching the second gallery 355. Furthermore, hydraulic fluid reaches the second gallery 355 only by flowing through metered passage 342, which has a cross sectional area designed to restrict the amount of oil flowing through it. Therefore, no hydraulic fluid bypasses the first gallery 360 and hydraulic fluid does not flow directly from sump 370 to the second gallery 355 when the control valve 365 is closed. The flow of hydraulic fluid will be described in more detail below with respect to FIGS. 5-7. Additionally or alternatively, the first annular gallery and the second annular gallery are in continuous fluidic communication via the metered passage 342, independent of control valve 365.

FIG. 3 depicts a single cylinder of an engine with an intake valve physically coupled to an auxiliary valve actuation system. The auxiliary valve actuation system is shown coupled to a hydraulic lash adjuster body for controlling the intake valve position. The hydraulic lash adjuster body comprising the metered hydraulic fluid passage on the outside of the hydraulic lash adjuster body, which is further described with respect to FIGS. 4A and 4B.

FIGS. 4A and 4B depict hydraulic lash adjusters 400 and 450, respectively. Hydraulic lash adjusters 400 and 450 may be used in the embodiment depicted in FIG. 3.

Turning now to FIG. 4A, a hydraulic lash adjuster 400 is depicted comprising a plunger 402, a top, outer spool 404, an upper annulus 406, an intermediate spool 408, a lower annulus 410, and a bottom, outer spool 412. Plunger 402, top, outer spool 404, upper annulus 406, intermediate spool 408, lower annulus 410, and bottom, outer spool 412 of hydraulic lash adjuster 400 may be substantially equal to plunger 325, top, outer spool 330, upper annulus 335, intermediate spool 340, lower annulus 345, and bottom, outer spool 350 of hydraulic lash adjuster 320 in one or more of a height, length, and diameter.

Hydraulic lash adjuster 400 further comprises a bore 401 housing the hydraulic lash adjuster 400 in a cylinder head. The bore 401 has a diameter slightly larger than the diameters of the top, outer spool 404, intermediate spool 408, and the bottom, outer spool 412. In this way, when the hydraulic lash adjuster 400 is located within the bore 401, the bore 401 is in face-sharing contact with the walls of the top, outer spool 404 and the bottom, outer spool 412 and is a snug fit. Additionally, the bore 401, represented by dashed lines, is in face-sharing contact with a portion of the intermediate spool 408 not including metered hydraulic fluid passage 416. The face-sharing contact between the bore 401 and the spools 404, 408, and 412 permit little to no hydraulic fluid to flow.

The upper annulus 406 and the lower annulus 410 may be substantially equal to each other in diameter. Alternatively, the upper annulus 406 and the lower annulus 410 may have unequal diameters. In one example, the lower annulus 410 may have a diameter greater than a diameter of the upper annulus 406. The annuli 406 and 410 have diameters smaller than the diameters of the spools 404, 408, and 412. As such, a separation between the upper annulus 406 and the bore 401 houses a second annular gallery. Likewise, a separation between the lower annulus 410 and the bore 401 houses a first annular gallery. In other words, the upper annulus 406 and lower annulus 410 are not in face-sharing contact with the bore 401. The second annular gallery and the first annular gallery may be substantially equal or unequal in volume.

A first gallery (e.g., first gallery 360) flows hydraulic fluid via a first conduit to the first annular gallery surrounding the lower annulus 410. The hydraulic fluid fills at least a portion of the first annular gallery and may begin to flow into a first hole 418. The first hole 418 leads into a gallery inside the hydraulic lash adjuster 400. The gallery provides oil to a low pressure reservoir of plunger 402 and is fluidly coupled to the first annular gallery. A cavity below the plunger 402 receives hydraulic fluid from the low pressure reservoir based on lash (e.g., gap between the rocker arm and cam lobe) and actuates the plunger based on the lash. For example, the first annular gallery may provide an increased amount of hydraulic fluid to the cavity when lash is increased.

The second annular gallery, located within the gap separating the upper annulus 406 and the bore 401, receives hydraulic fluid two different ways. During a latching mode, hydraulic fluid flows to the second annular gallery from the first annular gallery via a passage 416. The latching mode may include closing a control valve and keeping a cylinder activated. During an unlatching mode, hydraulic fluid flows to the second annular gallery from the second gallery via a second conduit. The unlatching mode may include opening a control valve and deactivating a cylinder. During both the latching mode and the unlatching mode, hydraulic fluid fills at least a portion of the second gallery and flows through a second hole 414. The second hole 414 is fluidly coupled to a passage located within the plunger 402. The passage fluidly couples the plunger 402 to a rocker arm (e.g., rocker arm 302). Therefore, hydraulic fluid flows from the second annular gallery, to the passage in the plunger 402, and into the rocker arm regardless of a position of the control valve (e.g., open or closed). When the control valve is open, high pressure hydraulic fluid flows into the rocker arm from the second annular gallery. Conversely, when the control valve is closed, low pressure hydraulic fluid flows into the rocker arm from the second annular gallery. The control valve and latching and unlatching modes will be described in more detail below. The second hole 414 and the first hole 418 may be located on the hydraulic lash adjuster 400 independent on one another. For example, the first hole 418 may be on an opposite side of the hydraulic lash adjuster 400 when compared to the second hole 414.

The holes 414 and 418 represent openings from the second gallery and the first gallery, respectively, to passages within the hydraulic lash adjuster.

The metered hydraulic fluid passage 416 is a flat located on a side of the intermediate spool 408. In one example, the flat may be formed via removing a segment of an intermediate spool such that the intermediate spool has a linear side. Therefore, the metered passage 416 holds a specific volume of hydraulic fluid between the intermediate spool 408 and the bore 401. In some embodiments, additionally or alternatively, the metered passage 416 may be adjusted such that the volume of the metered passage 416 may meet a desired volume. As depicted on the hydraulic lash adjuster 400, the metered passage 416 is axially and angularly aligned with the first hole 418 and the second hole 414. In some embodiments, the metered passage 416 may be angularly misaligned with one or more of the first hole 418 and the second hole 414, while remaining axially aligned. As depicted via the axial arrow, the axial direction is normal to a flat ground with which the hydraulic lash adjuster 400 may be resting. Furthermore, it should be understood that the metered passage 416, the first hole 418, and second hole 414 may be placed on any face of the hydraulic lash adjuster independent of one another. For example, the first hole 418, the second hole 414, and the metered passage 416 may all be misaligned, as will be described below.

Turning now to FIG. 9A, a transparent top-down view of a hydraulic lash adjuster 900 is shown. Hydraulic lash adjuster 900 may be substantially similar to hydraulic lash adjuster 400. The hydraulic lash adjuster 900 comprises a metered passage 902, a second gallery hole 904, and a first gallery hole 906. As depicted, the metered passage 902, the second gallery hole 904, and the first gallery hole 906 are axially and angularly aligned. Axial alignment may refer to a vertical axis extending through a center of the hydraulic lash adjuster, from a bottom of the hydraulic lash adjuster to a top of the hydraulic lash adjuster. Therefore, the second gallery hole 904 is the most vertical component along the axial axis.

The second gallery hole 904 eclipses the first gallery hole 906. As a result, there are 0 circular degrees between the second gallery hole 904 and the first gallery hole 906, indicating an angular alignment. Additionally, the second gallery hole 904 and the first gallery hole 906 are angularly aligned with the metered passage 902. Furthermore, the second gallery hole 904 and the first gallery hole 906 are radially aligned (e.g., radii of the second gallery hole 904 and the first gallery hole 906 are substantially equal). The second gallery hole 904 and the first gallery hole 906 are not radially aligned with the metered passage 902 because the metered passage 902 has a greater radius than both the second gallery hole 904 and the first gallery hole 906.

In an alternative embodiment, considering dashed metered passage 908 and disregarding metered passage 902, the second gallery hole 904 and first gallery hole 906 remain eclipsed while an angle 912 exists between the metered passage 908 and the second gallery hole 904 and the first gallery hole 906. Therefore, an angular misalignment corresponding to the angle 912 exists. In this way, the first gallery hole 906 and the second gallery hole 904 remain angularly aligned, while the dashed metered passage 908 is angularly misaligned. Additionally, the dashed metered passage 908, first gallery hole 906, and the second gallery hole 904 remain axially aligned.

Turning now to FIG. 9B, a transparent top-down view of a hydraulic lash adjuster 920 is shown. The hydraulic lash adjuster 920 may be substantially similar to either hydraulic lash adjuster 400 or 450. The hydraulic lash adjuster 920 comprises a metered passage 922, a second gallery hole 924, and a first gallery hole 926. As depicted, metered passage 922 and second gallery hole 924 are angularly aligned. Metered passage 922 and second gallery hole 924 are angularly misaligned with first gallery hole 926. The angular misalignment corresponds to angle 930. In this way, the second gallery hole 924 and the first gallery hole 926 may be radially and axially aligned, while being angularly misaligned.

In an alternative embodiment, considering dashed metered passage 928 and disregarding metered passage 922, the dashed metered passage 928 and the second gallery hole 924 are now angularly misaligned. The angular misalignment between the metered passage 928 and the second gallery hole 924 corresponds to angle 932. Likewise, the angular misalignment between the metered passage 928 and the first gallery hole 926 corresponds to angle 934. In this way, the metered passage 928, the second gallery hole 924, and the first gallery hole 926 may all be angularly misaligned while being axially aligned.

Turning now to FIG. 4C, a top-down cross section 420 (as indicated by dashed line 419) depicts a cutout of the intermediate spool 408 along with the bore 401 and the metered passage 416. It will be understood that a top-down view refers to a viewer looking downward on a portion of hydraulic lash adjuster 400 below dashed line 419 from above, as indicated by arrows of dashed line 419. The internal features of the hydraulic lash adjuster are not shown.

As depicted, the bore 401 is in face-sharing contact with a majority of the intermediate spool 408 except for a region of the intermediate spool 408 where the metered passage 416 is located, indicated by space 422. The space 422 represents an area for hydraulic fluid to flow between the first annular gallery of the lower annulus 410 and the second annular gallery of the upper annulus 406. Hydraulic fluid may flow from either the first annular gallery to the second annular gallery or from the second annular gallery to the first annular gallery, depending on a position of the control valve, as will be described below. The space 422 spans an entire length of a gap between the metered passage 416 and the bore 401.

Hydraulic fluid interacts with only an outside surface of the metered passage 416 and the bore 401 as it flows through the space 422 of the metered passage 416. In this way, hydraulic fluid passing through the metered passage 416 does not contact any components located within the hydraulic lash adjuster 400 while in the space 422 (e.g., the plunger 402 and any cavities located within the hydraulic lash adjuster 400). Said another way, hydraulic fluid flowing through the metered passage 416 is flowing on an external surface of the hydraulic lash adjuster 400 and is only in contact with the bore 401 and a surface of the metered passage 416 (e.g., intermediate spool 408).

As described above, the metered passage 416 has a specific cross-sectional area and therefore, allows a metered or restricted amount of hydraulic fluid to flow through its space 422. The metered passage 416 is fluidly coupled to both the first gallery and the second gallery. In this way, a limited amount of hydraulic fluid is provided to flow from first the first gallery to the second gallery when oil control valve 365 is closed, thereby limiting the pressure in the second gallery.

Turning now to FIG. 4B, a hydraulic lash adjuster 450 is shown. Bore 451, plunger 452, top, outer spool 454, an upper annulus 456, second hole 464, a lower annulus 460, first hole 468, and a bottom, outer spool 462 of hydraulic lash adjuster 450 may be substantially equal to similar components of hydraulic lash adjuster 400 of FIG. 4A. Intermediate spool 458 and metered passage 466 are substantially similar to intermediate spool 408 and metered passage 416 in function and size, but do differ in shape, as depicted in respective cross-sections 470 and 420.

Intermediate spool 458 of hydraulic lash adjuster 450 comprises a metered passage 466. The metered passage 466 resembles a cube-like groove, as shown in cross section 470, of FIG. 4D, of the intermediate spool 458.

Turning now to FIG. 4D, a top-down cross section 470 (as indicated by dashed line 469) depicts a cutout of the intermediate spool 458 along with the bore 451 and the metered passage 466. It will be understood that a top-down view refers to a viewer looking downward on a portion hydraulic lash adjuster 450 below dashed line 469 from above, as indicated by arrows of dashed line 469.

The metered passage 466 is substantially similar to metered passage 416 of hydraulic lash adjuster 400 except for its shape. As described above, metered passage 416 is a flat whereas metered passage 466 is a cube-like groove. Space 472, although different than space 422 of hydraulic lash adjuster 400 depicted in FIG. 4A, has a cross sectional area substantially equal to a volume of the space 422, despite their difference in shape. It will be appreciated by someone skilled in the art that other sufficient shapes may be formed into the intermediate spool to fluidly couple a first gallery to a second gallery (e.g., an arc).

FIGS. 4A and 4B represent embodiments of a hydraulic lash adjuster to be used with an auxiliary valve actuation system of engine 10. The hydraulic lash adjuster provides the auxiliary valve actuation system with hydraulic fluid in order to operate a valve of a cylinder dependent on current engine conditions. FIGS. 5-7 depict hydraulic circuit schematics of hydraulic lash adjusters fluidly coupled to various engine components and a crankcase sump.

Turning now to a FIG. 5, a hydraulic fluid circuit 500 depicts a high-level circuit to be used with an engine (e.g., one bank of engine 10). Hydraulic fluid circuit 500 includes four different hydraulic pathways including a hydraulic pathway equal to a pump pressure (indicated by solid lines), a restricted pathway of a first gallery 513 (indicated by large-dashed lines), a controlled pathway of a second gallery 515A and 515B (indicated by small-dashed lines), and a hydraulic pathway to flow to a crankcase sump (indicated by arrows).

Hydraulic fluid circuit 500 includes four cylinders. The four cylinders may be cylinders of a single bank of a V8 engine or of an in-line four cylinder engine. Outer cylinders 502 and inner cylinders 504 are coupled to hydraulic lash adjusters 506A, 506B and deactivating hydraulic lash adjusters 508A, 508B respectively. Hydraulic lash adjusters 506A, 506B are unable to deactivate a cylinder whereas deactivating hydraulic lash adjusters 508A, 508B are capable of deactivating cylinders. Therefore, only cylinders 504 may be deactivated in the present example. In some embodiments, all cylinders of an engine may be coupled to deactivating hydraulic lash adjusters. Deactivating hydraulic lash adjusters 508A, 508B may be similar to hydraulic lash adjuster 320, with respect to FIG. 3. Additionally or alternatively, a metered hydraulic fluid passage on the hydraulic lash adjusters 508A, 508B may be similar to the hydraulic passage 416 or the hydraulic passage 466 depicted with respect to FIGS. 4A and 4B. Hydraulic lash adjusters 506A and deactivating hydraulic lash adjusters 508A correspond to an intake valve. Additionally, hydraulic lash adjusters 506B and deactivating hydraulic lash adjusters 508B correspond to an exhaust valve. Therefore, each outer cylinder 502 and inner cylinder 504 comprises two intake valves and two exhaust valves. It will be appreciated by someone skilled in the art that the cylinders may comprise only one intake and exhaust valve or more than two intake and exhaust valves.

The hydraulic fluid circuit 500 draws hydraulic fluid (e.g., oil) from the crankcase sump 501 to oil pump 503. The oil pump provides hydraulic fluid to passage 511. A portion of the hydraulic fluid flows from the oil passage 511 to a restriction valve 512. The restriction valve 512 decreases a hydraulic fluid pressure (e.g., hydraulic fluid pressure is greater upstream of the restriction valve 512 than hydraulic fluid downstream of the restriction valve. The hydraulic fluid then flows to a first gallery 513, which bifurcates to direct the hydraulic fluid to both the intake side and exhaust side of the hydraulic fluid circuit 500. The first gallery 513 continuously receives hydraulic fluid from the oil pump 503 and directs the hydraulic fluid to various components of the engine. As depicted, the first gallery 513 is fluidly coupled to the camshafts 514A, 514B. The camshafts 514A and 514B comprise cam journals 516A and 516B respectively. The first gallery provides hydraulic fluid to the camshafts 514A, 514B in order to lubricate cam journals 516A and 516B of the camshafts 514A, 514B respectively.

The first gallery 513 is also fluidly coupled to hydraulic lash adjusters 506A, 506B and deactivating hydraulic lash adjusters 508A, 508B. The first gallery 513 supplies hydraulic fluid to hydraulic lash adjusters 506A, 506B and deactivating hydraulic lash adjusters 508A, 508B in order to compensate for lash, which may include actuating a plunger of hydraulic lash adjusters 506A, 506B and deactivating hydraulic lash adjusters 508A, 508B. The first gallery 513 continuously flows hydraulic fluid to first annular galleries of the hydraulic lash adjusters 506A, 506B and the deactivating hydraulic lash adjusters 508A, 508B, as described above.

The first gallery 513 is also fluidly coupled to the second galleries 515A and 515B. More specifically, as described above, the first annular gallery is fluidly coupled to second annular galleries via a metered passage, where the metered passage allows a limited amount of fluid to flow through a space between an intermediate spool and a bore. As a result, hydraulic fluid flowing from the first annular gallery to the second annular gallery decreases in pressure. Second galleries 515A and 515B are further divided into segments by plugs 520A and 520B respectively. The purpose of the plugs is to create distinct controlled oil galleries, each controlled by an individual oil control valve, such as 510A and 510B respectively. When operated in the closed state, oil control valves 510A and 510B may include a pressure regulating function such that if the pressure in galleries 515A or 515B exceeds a threshold pressure, fluid may flow through the oil control valve 510A or 510B to sump 501. It will be appreciated that in the condition when the oil control valve 510A or 510B is closed, the hydraulic fluid will preferentially flow through a metered passage of the hydraulic lash adjuster toward the oil control valve 510A or 510B, thereby pushing any trapped air out of gallery 515A or 515B through the oil control valve pressure relief valve, as will be discussed in greater detail below.

Hydraulic fluid may flow directly from the passage 511 to the second galleries 515A, and 515B only when control valves 510A, 510B are open, respectively. In this way, a portion of hydraulic fluid bypasses the first gallery and flows directly to the second galleries 515A, 515B. Additionally or alternatively, a restriction valve is not located between the pathways fluidly coupling the second galleries 515A, 515B and oil pump 501, and therefore the second galleries 515A, 515B receive a hydraulic fluid higher in pressure than the hydraulic fluid delivered to the first gallery 513 when the control valves 510A and 510B are open.

As depicted, the second galleries 515A and 515B are fluidly coupled to only the deactivatable hydraulic lash adjusters 508A and 508B, respectively. This may be because the second galleries 515A and 515B are switching galleries and are solely used for one or more of activating or deactivating a cylinder (e.g., cylinder(s) 504).

FIG. 5 depicts a high level hydraulic fluid flow schematic including a first gallery and a second gallery guiding hydraulic fluid from a sump to various components of an engine. FIGS. 6 and 7 depict a portion of the schematic in FIG. 5 under closed control valve conditions (e.g., an activated mode) and open control valve conditions (e.g., a deactivated mode), respectively.

Turning now to FIG. 6, a circuit 600 is depicted and is an example of a hydraulic fluid circuit in a cylinder activated mode (e.g., when a control valve 610 is closed). When the control valve 610 is closed, a cylinder is activated by allowing a pin in a rocker arm 628 to latch via flowing low pressure hydraulic fluid to the rocker arm 628. As used herein, oil pressure may have various levels and for convenience low oil pressure is referred to as a low pressure as compared to medium and high pressure oil, with medium pressure oil being higher than low pressure and lower than high pressure oil.

A first annular gallery 617 flows hydraulic fluid to the second annular gallery 624 via a metered passage 622. The metered passage 622 decreases a pressure of the hydraulic fluid flowing from the first annular gallery 617 to the second annular gallery 624 in order to allow an intake or exhaust valve to be actuated by a motion of the rocker arm 628, as described above. The first annular gallery 624 and second annular gallery 617 are in continuous fluidic communication.

Hydraulic lash adjuster 620 of circuit 600 may be substantially equal to hydraulic lash adjuster 400, with respect to FIG. 4A, or hydraulic lash adjuster 450, with respect to FIG. 4B. Furthermore, circuit 600 may be a circuit included in system 300 with respect to FIG. 3. In one example, hydraulic fluid flowing in the circuit 600 may be engine oil. Arrows depict a direction of hydraulic fluid flow with the circuit 600. Furthermore, a solid white arrow indicates movement of a low pressure hydraulic fluid, a striped arrow indicates movement of a medium pressure hydraulic fluid, and a solid black arrow indicates movement of a high pressure hydraulic fluid.

Pump 604, which is downstream of sump 602, draws hydraulic fluid from the sump 602. The pump 604 increases a pressure of the hydraulic fluid to be directed towards the remaining components of the circuit 600.

The high pressure hydraulic fluid generated by the pump 604 flows through a pump pathway 606, downstream of the pump 604. High pressure hydraulic fluid flows to both the first gallery 612 and the control valve 610. Hydraulic fluid flows from the pump pathway 606 to the control valve 610 via the control valve pathway 608. However, since the control valve 610 is closed, all the hydraulic fluid in the pump pathway 606 and control valve pathway 608 is directed toward the first gallery 612. In this way, no hydraulic fluid bypasses the first gallery 612 when the control valve 10 is closed. Additionally or alternatively, hydraulic fluid does not flow directly from the sump to the second gallery 629 when the control valve 610 is closed. As will be described in further detail below, when the control valve 610 is closed, hydraulic fluid flows from the sump 602 to the first gallery 612, through a metered passage 622, and into the second gallery 624.

The high pressure hydraulic fluid flowing in the first gallery 612 may be reduced in pressure via a metered passage 614 before reaching any components fluidly coupled to the first gallery 612. In other words, the metered passage 614 is upstream of all outlets of the first gallery 612. In this way, hydraulic fluid flowing from the first gallery 612 to components fluidly coupled to the first gallery 612 is lower in pressure than hydraulic fluid entering the first gallery 612. In another embodiment, metered passage 614 may be eliminated such that high pressure oil is allowed to flow to gallery 617 without a restriction.

Medium pressure hydraulic fluid flows through the first gallery 612 and reaches a cam journal outlet 615, upstream of the hydraulic lash adjuster 620. A portion of hydraulic fluid from the first gallery 612 is diverted to the cam journal outlet 615. The hydraulic fluid flowing through the cam journal outlet 615 has a pressure substantially equal to the hydraulic pressure flowing through the first gallery 612. Hydraulic fluid flows from the cam journal outlet 615 to cam bearings 616. As an example, the cam bearings 616 may be cam bearings of a camshaft 514A or camshaft 514B, with respect to FIG. 5.

A remaining portion of hydraulic fluid not diverted to the cam journal outlet 615 is directed to the first annular gallery 617 located in the hydraulic lash adjuster 620. More specifically, the first annular gallery 617 is located within a space between a lower annulus of the hydraulic lash adjuster 620 and a bore housing the hydraulic lash adjuster 620 as described above. The first annular gallery 617 is a continuation of the first gallery 612 and is fluidly coupled to a first conduit of the first gallery 612. Hydraulic fluid in the metered passage 622 does not flow back into the first annular passage 617 when the control valve 610 is closed. In this way, the first annular passage 617 only provides hydraulic fluid to the metered passage 622 when the control valve 610 is closed.

Hydraulic fluid in the first annular gallery 617 may flow in three directions, which include flowing into one or more of a cavity of the hydraulic lash adjuster 620 to actuate a plunger, a metered passage 622, and a continuing gallery 618. Hydraulic fluid flowing through the continuing gallery 618 may flow to other components of the engine such as additional cam bearings and/or hydraulic lash adjusters on the same cylinder or different cylinders of an engine.

Hydraulic fluid flowing through the metered passage 622 decreases in pressure as it flows up into the second annular gallery 624. Therefore, hydraulic fluid entering the metered passage 622 is higher in pressure than hydraulic fluid exiting the metered passage 622. The hydraulic fluid flows from the first gallery 612 to the second annular gallery 624 via the metered passage due to a difference in pressure (e.g., the hydraulic fluid flows from the medium pressure first gallery 612 to the low pressure second annular gallery 624). More specifically, the hydraulic fluid flows from the first gallery 612, to the first annular gallery 617, up the metered passage 622, and into the second annular gallery 624, without contacting or interacting with any components located within the hydraulic lash adjuster 620.

Hydraulic fluid in the second annular gallery 624 may flow to one or more of a second conduit of the second gallery 629 and a plunger passage 626. The second conduit directs hydraulic fluid to the second gallery 629 whereas the plunger passage 626 directs hydraulic fluid to a rocker arm 628. Hydraulic fluid in the second annular gallery 624 does not flow into the metered passage 622 when the control valve 610 is closed. Therefore, the second annular gallery 624 may only receive hydraulic fluid from the metered passage 622 when the control valve 610 is closed.

The plunger passage 626 is an internal passage which provides a continuous hydraulic fluid passage from the second annular gallery 624, through a hole in the hydraulic lash adjuster body (not shown), to an interior of the hydraulic lash adjuster 620, and up through the plunger to exit a top of the plunger. Plunger passage 626 is fluidly coupled to a cavity of the rocker arm 628. The plunger passage 626 receives low pressure hydraulic fluid, delivers it to the rocker arm 628 and as a result, a pin in the rocker arm 628 is latched when the control valve 610 is closed. As mentioned above, the rocker arm 628 may be used to actuate an intake valve or an exhaust valve.

The remaining portion of hydraulic fluid flows toward the second conduit and into the second gallery 629. The second gallery 629 directs hydraulic fluid through a portion of control valve 610 to a pressure relief valve 632 via a pressure relief inlet valve 630. As described above, air may be trapped in the second gallery 629 due to aerated hydraulic fluid flowing into the gallery. Additionally or alternatively, air could enter the gallery when the engine is not running and hydraulic fluid leaks out of the galleries through clearances between components. Trapped air may hinder an operation of the hydraulic fluid circuit and rate at which the pressure of hydraulic fluid may be switched between high and low or between low and high. The trapped air may be carried through the second gallery 629, into the pressure relief valve inlet 630, and to the pressure relief valve 632. The pressure relief valve 632 purges the trapped air from the second gallery 629. The hydraulic fluid then flows to an exit pathway 634, downstream of the pressure relief valve 632, where it flows into the sump 602.

FIG. 6 depicts an example flow of a hydraulic fluid when a control valve is closed in a cylinder activated mode. FIG. 7 illustrates an example flow of hydraulic fluid when the control valve is open in a cylinder deactivated mode.

Turning now to FIG. 7, a system 700 depicts a flow of hydraulic fluid when the control valve 610 is open. By opening the control valve 610, hydraulic fluid flows directly to a second gallery 629 in order to deactivate a cylinder of an engine. Components previously introduced in FIG. 6 are numbered similarly and not re-introduced here for reasons of brevity.

Components illustrated in FIG. 7 are similar to those illustrated in FIG. 6. Furthermore, hydraulic fluid flow from the first gallery 612 to metered passage 614, cam journal outlet 615, cam bearings 616, first annular gallery 617, and continuing gallery 618 depicted in FIG. 6 is similar to the hydraulic flow through of FIG. 7 through similar components. Therefore, for reasons of brevity, the hydraulic flow through the aforementioned components will not be described again. Furthermore, a solid white arrow indicates movement of a low pressure hydraulic fluid, a striped arrow indicates movement of a medium pressure hydraulic fluid, and a solid black arrow indicates movement of a high pressure hydraulic fluid.

Pump 604, which is downstream of sump 602, draws hydraulic fluid from the sump 602. The pump 604 increases a pressure of the hydraulic fluid to be directed towards the remaining components of the circuit 600.

The high pressure hydraulic fluid generated by the pump 604 flows through a pump pathway 606, downstream of the pump 604. High pressure hydraulic fluid flows to both the first gallery 612 and the control valve 610. Hydraulic fluid flows from the pump pathway 606 to the control valve 610 via the control valve pathway 608. Due to the control valve 610 being in an open position, the high pressure hydraulic fluid flows directly to the second gallery 629. Furthermore, since hydraulic fluid in the second gallery 629 is flowing toward the second annular gallery 624 when the control valve 610 is open, the control valve 610 does not provide a connection from the second gallery 629 to pressure relief valve inlet 630 and the hydraulic fluid does not flow through any one of a pressure relief valve inlet 630, pressure relief valve 632, and exit passage 634. Therefore, hydraulic fluid in the present example depicted in FIG. 7 may not return to the sump 602 other than through leakage between components.

As depicted, the second gallery 629 does not comprise a metered passage similar to metered passage 614 of the first gallery 612. As a result, a pressure of the second gallery 629 is greater than a pressure of the first gallery 612. The high pressure hydraulic fluid flows from the second gallery 629 to the second annular gallery 624 via a second conduit fluidly coupled to the second gallery 629. The high pressure hydraulic fluid flows to the second annular gallery 624 and fills at least a portion of the second annular gallery 624 before flowing to the plunger passage 626. The plunger passage 626 directs the high pressure hydraulic fluid to the rocker arm 628, where the high pressure hydraulic fluid is able to unlatch a pin of the rocker arm 628. By unlatching the pin, a valve coupled to the rocker arm 628 no longer actuates corresponding to an actuation of the rocker arm 628 (e.g., lost motion). Therefore, the valve of the cylinder is shut closed and cannot be actuated until the pin is latched again. In some embodiments, additionally or alternatively, deactivating a cylinder may include unlatching all pins corresponding to any intake and exhaust valves of the cylinder. In this way, all the valves of a cylinder are stuck closed.

Additionally or alternatively, a small amount of hydraulic fluid in the second annular gallery 624 may also flow to the first annular gallery 617 via the metered passage 622 due to the pressure difference between the second annular gallery 624 and the first annular gallery 617 (e.g., high pressure of the second gallery compared to the medium pressure of the first gallery). In this way, when the control valve 610 is open, hydraulic fluid flows from the second gallery 629, through the metered passage 622, and into the first gallery 612. More specifically, the hydraulic fluid flows from the second gallery 629, to the second annular gallery 624, through the metered passage 622, and into the first annular gallery 617, when the control valve 610 is open.

FIGS. 6 and 7 illustrate examples of hydraulic fluid flow through a hydraulic circuit when a control valve is either closed or open, respectively. In the example demonstrating a closed control valve, hydraulic fluid could not flow directly from a sump to a second gallery. Therefore, all the hydraulic fluid provided to the hydraulic circuit is directed towards a first gallery. The first gallery provides hydraulic fluid to various components of the engine and also to the second gallery via a metered passage. Hydraulic fluid flowing through the metered passage is surrounded by and interacts only with both of a bore and the metered passage of an intermediate spool. The hydraulic fluid flowing to the second gallery when the control valve is closed is not high enough in pressure to unlatch a pin of a rocker arm. Therefore, a cylinder may remain active. Additionally or alternatively, the hydraulic fluid flowing through the second gallery may carry any trapped air in the second gallery with it to a pressure relief valve to allow the trapped air to be expelled from the second gallery.

In the other example demonstrating an open control valve, hydraulic fluid was permitted to flow directly to the second gallery. As a result, at least a portion of hydraulic fluid bypassed the first gallery, hydraulic fluid in the second gallery was greater in pressure than hydraulic fluid in the first gallery, and a direction of hydraulic fluid flow was inverted in the second gallery with respect to a direction of flow in the second gallery when the control valve was closed. For example, when the control valve was closed, hydraulic fluid in the second gallery flowed away from a hydraulic lash adjuster. When the control valve is open, hydraulic fluid in the second gallery flows toward the hydraulic lash adjuster, and thus inverts the direction of hydraulic fluid flow.

The high pressure hydraulic fluid flowing directly to the second gallery is directed toward the rocker arm and unlatches the pin of the rocker arm and as a result, a valve of the cylinder is stuck closed in order to deactivate the cylinder.

Turning now to FIG. 8, a method 800 is illustrated for closing a control valve to flow hydraulic fluid from a first annular gallery to a second annular gallery of a hydraulic lash adjuster via a metered hydraulic fluid passage. The metered hydraulic fluid passage is positioned on an outer surface of a hydraulic lash adjuster intermediate spool between the first and second annular galleries. The method further comprises opening a control valve to flow hydraulic fluid directly to the second gallery from the control valve.

Instructions for carrying out method 800 included herein may be executed by a controller (e.g., controller 12) based on instructions stored on a memory of the controller and in conjunction with signals received from sensors of the engine system, such as the sensors described above with reference to FIGS. 1 and 2. The controller may employ engine actuators of the engine system to adjust engine operation, according to the methods described below. It should be understood that the method 800 may be applied to other systems of a different configuration without departing from the scope of this disclosure.

The approach described herein senses an engine load decreasing below a threshold load in order to open a control valve. As described above, by opening the control valve, high pressure hydraulic fluid flows directly to a second gallery which directs the hydraulic fluid to a rocker arm of a cylinder. The high pressure hydraulic fluid unlatches a pin of the rocker arm which creates lost motion (e.g., rocker arm actuates without actuating a valve of the cylinder). The cylinder is deactivated until the engine load exceeds the threshold load and the control valve is returned to a closed position.

Method 800 begins at 802 to determine, estimate, and/or measure current engine operating parameters. The engine operating parameters include, but are not limited to engine load, engine speed, manifold vacuum, vehicle speed, and/or air/fuel ratio.

At 804, the method 800 includes determining if the engine load is less than a threshold load. The threshold load may be based on a low engine load. If the engine load is not less than the threshold load, then the method 800 proceeds to 806 to maintain current engine operating parameters, which includes not deactivating a cylinder and keeping all cylinders activated.

If the engine load is less than the threshold load, then the method 800 proceeds to 808 to deactivate one or more cylinders of the engine (e.g., deactivation mode). Deactivating one or more cylinders includes selecting which cylinder (s) to deactivate at 810, opening the control valve at 812, and flowing hydraulic fluid (e.g., engine oil) from a sump, through a switching gallery, and to a rocker arm in order to unlatch a pin of the rocker arm at 814.

Selecting which cylinder(s) to deactivate at 810 may include, but is not limited to, one or more or of identifying which cylinders are able to be deactivated (e.g., cylinder(s) coupled to a deactivatable hydraulic lash adjuster), identifying which cylinder(s) were deactivated during the last instance of a deactivation mode occurring. For example, with reference to FIG. 5, cylinders 504 are coupled to deactivating hydraulic lash adjusters 508A, 508B while cylinders 502 are coupled to hydraulic lash adjusters 506A, 506B. In this way, only cylinders 504 may be selected to be deactivated. Furthermore, deactivating a cylinder includes opening control valves corresponding to one or more deactivating hydraulic lash adjusters corresponding to either an intake valve or exhaust valve or a cylinder. For example, with reference to FIG. 5, cylinders 504 are deactivated via opening control valves 510A and 510B the intake valves and exhaust valves are stuck closed.

The identifying which cylinder(s) were deactivated during the previous instance of the control valve being open may be used in order to alter which cylinder(s) are deactivated during an instance of the control valve being open. For example, if a first cylinder of a four cylinder engine was deactivated during a current deactivation mode, then the method 800 may select a cylinder different than the first cylinder to deactivate during a subsequent deactivation operation. Additionally or alternatively, the selection of which cylinder(s) to deactivate may be based on a firing order (e.g., if a firing order is 1-4-3-2 and cylinder 3 is currently being fired, then cylinder 4 may be selected as a cylinder to be deactivated).

Opening the control valve and flowing hydraulic fluid directly from the control valve to the second annular gallery results in increasing a pressure of the second annular gallery. The high pressure hydraulic fluid flows from the second annular gallery to the rocker arm and unlatches a pin within the rocker arm. When the pin is unlatched a corresponding valve is stuck closed and a cylinder becomes deactivated. Additionally or alternatively, deactivating a cylinder includes closing all the valves of the cylinder via unlatching all the pins of corresponding rocker arms.

At 816, the method 800 includes disabling fuel injections and/or spark to only the deactivated cylinders. If cylinders 504 are deactivated, while cylinders 502 are firing, then a controller may signal to deactivate spark and fuel injections to only the cylinders 504, with respect to FIG. 5. In this way, when a cylinder(s) is deactivated, its intake valve(s) and exhaust valve(s) are closed shut and the cylinder(s) does not receive fuel injections and/or spark.

At 818, the method 800 includes determining if the engine load is greater than the threshold load. If the engine load is still less than the threshold load (e.g., low load), then the method 800 continues to 819 to maintain the control valve(s)

in the open position and fuel and spark disabled only on deactivated cylinder(s) until the engine load is greater than the threshold engine load.

If the engine load is greater than the threshold engine load, then the method 800 proceeds to 820 to close the control valve(s) in order to activate the deactivated cylinder (s). By closing the control valve, hydraulic fluid no longer flows directly from the control valve to the second annular gallery. Furthermore, the second annular gallery only receives hydraulic fluid from a first annular gallery via a metered passage on an external surface of the hydraulic lash adjuster when the control valve is closed.

In this way, a hydraulic lash adjuster that is both compact and capable of expelling trapped air from a switching gallery may be realized. Additionally, by positioning a metered passage on an external body of a hydraulic lash adjuster, a primary gallery and switching gallery may be positioned on any side of the hydraulic lash adjuster independent of one another. No orienting feature is required on the hydraulic lash adjuster to maintain a position of the hydraulic lash adjuster to the bore. This further increases the utility of the compact design of the hydraulic lash adjuster.

The technical effect of positioning a metered passage of an external surface of a hydraulic lash adjuster is so a primary gallery can be fluidly coupled to a switching gallery in order to both expel air from the switching gallery and deactivate/activate a cylinder of an engine. The metered passage allows a metered amount of hydraulic fluid to pass through its opening such that a hydraulic pressure of either the primary gallery or the switching gallery is maintained.

A method for an engine comprising closing a control valve to flow hydraulic fluid from a first annular gallery to a second annular gallery of a hydraulic lash adjuster via a metered hydraulic fluid passage positioned between the first and second annular galleries and on an outer surface of a hydraulic lash adjuster intermediate spool. The method, additionally or alternatively, further comprises opening the control valve to flow hydraulic fluid directly to the second annular gallery from the control valve. The hydraulic fluid flowing through the metered hydraulic fluid passage is contained within the metered hydraulic fluid passage and a bore of the hydraulic lash adjuster without the hydraulic fluid interacting with any components located in the hydraulic lash adjuster. The method further comprising opening the control valve results in increasing a pressure of the second annular gallery and deactivating a cylinder. The method further comprising by switching a position of the control valve, a direction of hydraulic fluid flow is inverted in a second annular gallery conduit.

The method further comprising closing the control valve results in the first annular gallery being greater in pressure than the second annular gallery, and opening the control valve results in the second annular gallery being greater in pressure than the first annular gallery. The first annular gallery continuously receives substantially equal hydraulic fluid flow and pressure regardless of the control valve position.

A hydraulic lash adjuster comprising an outer body including a first gallery for mitigating lash in a variable displacement engine and a second gallery for providing hydraulic fluid to an auxiliary valve actuation system. The first gallery is located on a first, lower annulus and the second gallery is located on a second, upper annulus of the hydraulic lash adjuster and where the first annulus and the second annulus are vertically separated by an outer diameter of the hydraulic lash adjuster body. The first gallery is fluidly coupled to a first conduit and the second gallery is fluidly coupled to a second conduit. The first gallery is fluidly coupled to the second gallery via a metered passage in an outer body of the outer diameter of the hydraulic lash adjuster body. The hydraulic lash adjuster is both physically coupled to and fluidly coupled to an auxiliary valve actuating mechanism. Hydraulic fluid flowing through the metered passage is surrounded by and interacts with a bore and the metered passage. The hydraulic fluid flow through the metered passage is inverted based on an engine operation. The first gallery and the second gallery are vertically disposed and are located on any side of the hydraulic lash adjuster independent of one another.

The hydraulic lash adjuster further comprising the first annulus and second annulus with substantially equivalent diameters. In one example, substantially equivalent diameters may include diameters within 1% or less of one another. The outer diameter of the hydraulic lash adjuster body has a greater diameter then a diameter of the first annulus and the second annulus. A pressure of the first gallery is substantially constant and a pressure of the second gallery is altered.

A system comprising at least one hydraulic lash adjuster disposed in a residence bore in a cylinder head. Additionally or alternatively, a switchable cam follower actuated by hydraulic fluid fed through a plunger of the hydraulic lash adjuster. A first gallery and second gallery are separated by an outer diameter of the hydraulic lash adjuster body. The first gallery located on a first annulus and the second gallery located on a second annulus, where the annuli are fluidly connected by an external passage formed into the outer diameter. A controller with computer readable instructions for controllably supplying hydraulic fluid to an auxiliary valve actuation system via opening a control valve to flow hydraulic fluid directly to the second gallery to increase a pressure of the second gallery, and where the second gallery is fluidly coupled to the auxiliary valve actuation system. The controller further comprises computer readable instructions for closing a control valve in order to disable flowing hydraulic fluid directly to the second gallery and to decrease a pressure of the second gallery.

The system further comprises the second gallery being fluidly coupled to the plunger. The hydraulic fluid is provided from a sump of an engine. The first gallery lubricates a cam journal and accounts for lash compensation and the second gallery accounts for at least deactivating a valve. The hydraulic fluid flows through the external passage from the first gallery to the second gallery when the control valve is closed, and wherein the hydraulic fluid flows through the external passage from the second gallery to the first gallery when the control valve is open.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The technology can also be applied to valve actuation systems that switch between high and low valve lift heights rather than keeping valves shut to deactivate a cylinder. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

closing a control valve to flow hydraulic fluid from a first annular gallery to a second annular gallery of a hydraulic lash adjuster via a metered hydraulic fluid passage positioned between the first and second annular galleries and on an outer surface of a hydraulic lash adjuster intermediate spool; and opening the control valve to flow hydraulic fluid directly to the second annular gallery from the control valve.

2. The method of claim 1, wherein flowing hydraulic fluid through the metered hydraulic fluid passage includes the hydraulic fluid being contained within the metered hydraulic fluid passage and a bore of the hydraulic lash adjuster without flowing through internal passages of the hydraulic lash adjuster.

3. The method of claim 1, wherein opening the control valve increases a pressure of the second annular gallery.

4. The method of claim 1, wherein switching a position of the control valve inverts a direction of a flow of hydraulic fluid in a second annular gallery conduit.

5. The method of claim 1, wherein opening the control valve deactivates a cylinder of an engine.

6. The method of claim 1, wherein closing the control valve results in the first annular gallery being greater in pressure than the second annular gallery, and opening the control valve results in the second annular gallery being greater in pressure than the first annular gallery.

7. The method of claim 1, wherein hydraulic fluid continuously flows directly from a pump to the first annular gallery during engine operation.

8. A hydraulic lash adjuster, comprising:

a one piece plunger body coupled to a first gallery for mitigating lash in a variable displacement engine and a second gallery for providing hydraulic fluid to an auxiliary valve actuation system, wherein the first gallery is located on a first, lower annulus and the second gallery is located on a second, upper annulus of the hydraulic lash adjuster and where the first annulus and the second annulus are vertically separated by an outer diameter of the hydraulic lash adjuster body, the first gallery is fluidly coupled to a first conduit and the second gallery is fluidly coupled to a second conduit, and the first gallery is fluidly coupled to the second gallery via a metered passage in an outer body of the outer diameter of the hydraulic lash adjuster body.

9. The hydraulic lash adjuster of claim 8, wherein the second gallery is further fluidly coupled to a passage of the one piece plunger body.

10. The hydraulic lash adjuster of claim 8, wherein the metered passage allows a metered amount of hydraulic fluid to flow through from either the first gallery to the second gallery or the second gallery to the first gallery.

11. The hydraulic lash adjuster of claim 8, wherein each of an opening of the first gallery, an opening of the second gallery, and the metered passage is angularly and axially aligned along the hydraulic lash adjuster.

12. The hydraulic lash adjuster of claim 8, wherein at least two of an opening of the first gallery, an opening of the second gallery, and the metered passage are axially aligned while being angularly misaligned along the hydraulic lash adjuster.

13. The hydraulic lash adjuster of claim 8, wherein the first annulus and second annulus have substantially equivalent diameters, and wherein the outer diameter of the hydraulic lash adjuster body has a greater diameter then a diameter of the first annulus and the second annulus.

14. The hydraulic lash adjuster of claim 8, wherein the first gallery and the second gallery are not coupled inside the hydraulic lash adjuster.

15. A system, comprising:

at least one hydraulic lash adjuster disposed in a residence bore;

at least one switchable cam follower actuated by hydraulic fluid fed through a plunger of the hydraulic lash adjuster;

a first gallery and second gallery, where the first gallery and second gallery are separated by an outer diameter of the hydraulic lash adjuster body;

the first gallery located on a first annulus and the second gallery located on a second annulus, where the annuli are fluidly connected by an external passage along the outer diameter; and a controller with computer readable instructions stored in memory for:

controllably supplying hydraulic fluid to an auxiliary valve actuation system via opening a control valve to flow hydraulic fluid directly to the second gallery to increase a pressure of the second gallery, and where the second gallery is fluidly coupled to the auxiliary valve actuation system.

16. The system of claim 15, wherein the controller further comprises computer readable instructions for closing a control valve to disable flowing hydraulic fluid directly to the second gallery and to decrease a pressure of the second gallery.

17. The system of claim 15, wherein the second gallery is fluidly coupled to the plunger.

18. The system of claim 15, wherein the first gallery and second gallery are fluidly coupled to a sump of the engine.

19. The system of claim 15, wherein the first gallery and the second gallery are in fluidic communication outside of the hydraulic lash adjuster body.

20. The system of claim 15, wherein the control valve is positioned in a passage fluidly coupling the second gallery to a sump, and wherein the passage is downstream of a conduit leading to the first gallery.

* * * * *